US008721023B2

(12) United States Patent
Yamashita et al.

(10) Patent No.: US 8,721,023 B2
(45) Date of Patent: May 13, 2014

(54) RECORDING DEVICE

(71) Applicant: Seiko Epson Corporation, Tokyo (JP)

(72) Inventors: Norihiro Yamashita, Nagano (JP); Hideo Mikuriya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/950,629

(22) Filed: Jul. 25, 2013

(65) Prior Publication Data

US 2013/0307894 A1 Nov. 21, 2013

Related U.S. Application Data

(63) Continuation of application No. 13/037,718, filed on Mar. 1, 2011, now Pat. No. 8,517,497.

(30) Foreign Application Priority Data

Mar. 15, 2010 (JP) ..... 2010-057142

(51) Int. Cl.

| | |
|---|---|
| ***B41J 29/38*** | (2006.01) |
| ***B41J 13/00*** | (2006.01) |
| ***B41J 13/02*** | (2006.01) |
| *B41J 11/00* | (2006.01) |

(52) U.S. Cl.

CPC ..... *B41J 13/0009* (2013.01); *B41J 13/025* (2013.01); *B41J 11/007* (2013.01)

USPC ..... 347/16

(58) Field of Classification Search

CPC .. B65H 3/5261; B41J 13/0009; B41J 13/025; B41J 11/007

USPC ..... 347/16, 101, 104; 271/121, 125

See application file for complete search history.

(56) References Cited

U.S. PATENT DOCUMENTS 7,392,980 B2 7/2008 Takeuchi et al.

FOREIGN PATENT DOCUMENTS

| | | | |
|---|---|---|---|
| JP | 09-040209 | A | 2/1997 |
| JP | 10-133499 | A | 5/1998 |
| JP | 2005-162470 | A | 6/2005 |
| JP | 2008-302536 | A | 12/2008 |

*Primary Examiner* — An Do

(74) *Attorney, Agent, or Firm* — Global IP Counselors, LLP

(57) ABSTRACT

A recording apparatus includes a roller and a control device. The roller is configured and arranged to convey a recording medium. The control device is configured and arranged to set a pressure load of the roller contacting with the recording medium. The control device is configured and arranged to set the pressure load of the roller to a first pressure load when the recording medium is conveyed, and to set the pressure load of the roller to a second pressure load which is lower than the first pressure load when the recording medium is not conveyed while the roller is in contact with the recording medium.

13 Claims, 7 Drawing Sheets

RECORDING DEVICE

CROSS-REFERENCE TO RELATED APPLICATIONS

This application is a continuation application of U.S. Pat. No. 8,517,497 issued on Aug. 27, 2013. This application claims priority to Japanese Patent Application No. 2010-057142 filed on Mar. 15, 2010. The entire disclosures of U.S. Pat. No. 8,517,497 and Japanese Patent Application No. 2010-057142 are hereby incorporated herein by reference.

BACKGROUND

1. Technical Field

The present invention relates to a recording device comprising a conveying device for conveying a recording medium to a recording performing region.

2. Related Art

Among recording devices that comprise a conveying device for conveying a recording medium to a recording performing region, those that are capable of performing recording on a roll paper or another elongated recording medium wound around a shaft (hereinbelow referred to simply as "roll paper or the like"), for example, are conventionally known. As a preparatory operation for performing recording on a roll paper or the like in such a recording device, a user must manually perform an operation for setting the roll paper or the like in a roll paper holder or the like of the recording device. More specifically, a user must manually perform first an operation for axially supporting a shaft on which the roll paper or the like is wound on a roll paper holder or the like, and then an operation for sandwiching the distal end vicinity of the roll paper or the like between a pair of rollers of the conveying device. However, once the roll paper or the like has been set in the roll paper holder or the like, as long as the roll paper or the like remains sandwiched in the roller pair of the conveying device, the user's manual operation is not needed until the roll paper or the like has been completely used up, and this aspect can be said to be one merit of using roll paper or the like.

However, when the roll paper or the like remains sandwiched for long periods of time in the roller pair of the conveying device, a color change sometimes occurs or pressure marks sometimes are left in the portion of the recording surface of the roll paper or the like where the roller comes in contact. When the roller that contacts the recording surface is a rubber roller, the color change in the recording surface of the roll paper or the like occurs due to tiny amounts of chemicals, oils, or the like included in the rubber roller being deposited on the recording surface of the roll paper or the like. The pressure marks of the recording surface of the roll paper or the like are formed when the portion sandwiched in the roller pair gradually deforms due to the pressure load of the roller pair continuing to act on the roll paper or the like for a long period of time. Such color changes or pressure marks can be the cause of reducing the quality of the recorded image when recording is performed on the roll paper or the like.

As an example of a conventional technology intended to resolve such problems, a recording device in which the external peripheral surface of the rubber roller in contact with the recording surface of the roll paper or the like is covered with a resin film is conventionally known (see Japanese Laid-Open Patent Publication No. 2005-162470, for example). With this conventional technology, since the resin film covering the external peripheral surface of the rubber roller comes in contact with the recording surface of the roll paper or the like, the chemicals, oils, or the like contained in the rubber roller can be prevented from being deposited on the recording surface of the roll paper or the like, and color changes in the roll paper or the like can thereby be prevented.

SUMMARY

However, in a conveying device in which the roll paper or the like is sandwiched by a roller pair and the roll paper or the like is conveyed to a recording performing region by the rotation of the roller pair, the pressure load of the roller pair must still of course be maintained at or above a certain constant in order to achieve stable conveying free of slipping or the like. In other words, regardless of whether or not a resin film covers the external peripheral surface of the rubber roller in contact with the recording surface of the roll paper or the like, the contact surface area of the rubber roller on the roll paper or the like mostly does not change, and the necessary pressure load therefore also is expected to mostly not change. Therefore, according to the conventional technology disclosed in Japanese Laid-Open Patent Publication No. 2005-162470, there is still the risk of pressure marks being formed in the roll paper or the like even if color changes in the roll paper or the like can be prevented from occurring.

For example, when recording is not performed on the roll paper or the like for a long period of time, the forming of pressure marks on the roll paper or the like can be avoided by the user performing an operation for removing the roll paper or the like from the roll paper holder or the like. However, the user sometimes forgets and leaves the roll paper or the like set in the roll paper holder or the like. If the operation for removing the roll paper or the like from the roll paper holder or the like must be performed frequently, this compromises convenience, which is one merit of using the roll paper or the like.

When, for example, a release mechanism or the like is provided which is capable of causing the rollers of the roller pair of the conveying device to separate from each other and recording is not performed on the roll paper or the like for a long period of time, it is possible to avoid the formation of pressure marks on the roll paper or the like by releasing the sandwiching of the roll paper or the like by the roller pair of the conveying device. However, when the sandwiching of the roll paper or the like by the roller pair is released, the distal end vicinity of the roll paper or the like becomes free to move, and there is therefore a risk that the distal end vicinity of the roll paper or the like will separate from the range where it can be sandwiched again by the roller pair, due to the wound curls, of the roll paper or the like, the elastic return force, or other factors. In other words, there is a risk that it will eventually become necessary for the user to again perform the operation for setting the roll paper or the like. Therefore, convenience is compromised, which is of course one merit of using the roll paper or the like.

The present invention was devised in view of such circumstances, and an object of the present invention is to reduce the risk of forming pressure marks from the roller on the recording surface of the roll paper or the like without compromising convenience, which is one merit of using roll paper or the like.

A recording apparatus according to one aspect includes a roller and a control device. The roller is configured and arranged to convey a recording medium. The control device is configured and arranged to set a pressure load of the roller contacting with the recording medium. The control device is configured and arranged to set the pressure load of the roller to a first pressure load when the recording medium is conveyed, and to set the pressure load of the roller to a second pressure load which is lower than the first pressure load when the recording medium is not conveyed while the roller is in contact with the recording medium.

When the roll paper or the like is conveyed to the recording performing region, the pressure load of the roller is set to the first pressure load, whereby the roll paper or the like can held with a pressure load sufficient to achieve stable conveying in which slipping does not occur. On the other hand, when recording is not performed on the roll paper or the like for a long period of time, the pressure load of the roller is set to the second pressure load which is lower than the first pressure load, whereby the risk of forming pressure marks in the recording surface of the roll paper or the like can be reduced while keeping the roll paper or the like sandwiched in the roller pair.

Thereby, according to this aspect of the present invention, an operational effect is achieved wherein the risk of forming pressure marks from the roller in the recording surface of the roll paper or the like can be reduced without compromising convenience, which is one merit of using roll paper or the like.

According to such characteristics, it is possible to improve the operability when the user performs the operation of setting the roll paper or the like in the recording device and the operation of removing the roll paper or the like from the recording device.

BRIEF DESCRIPTION OF THE DRAWINGS

Referring now to the attached drawings which form a part of this original disclosure.

DETAILED DESCRIPTION OF EXEMPLARY EMBODIMENTS

The present invention is described hereinbelow based on the drawings.

Overall Configuration of Inkjet Printer 1

Figure 1:
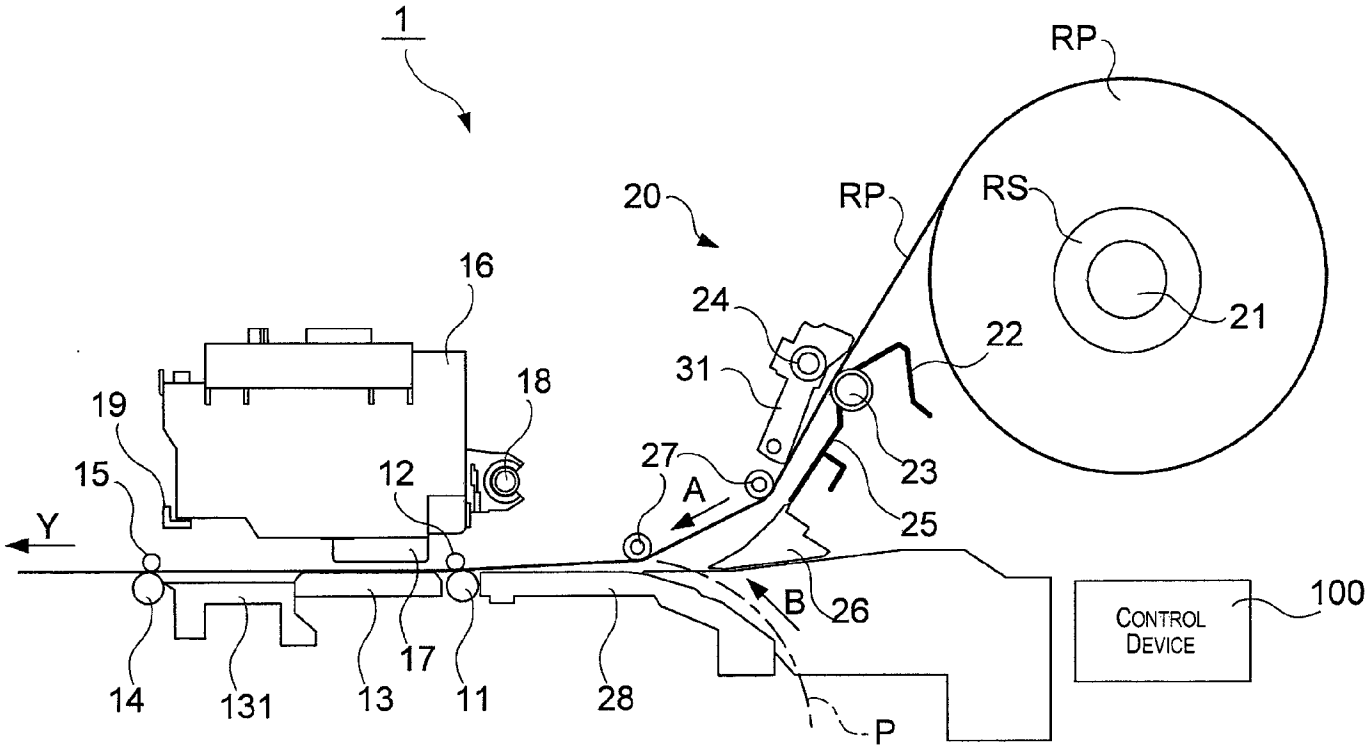
FIG. 1 is a partial side view of an inkjet printer.

The overall configuration of an inkjet printer 1 is described while referring to FIG. 1.

FIG. 1 is a partial side view of the inkjet printer 1.

The inkjet printer 1 as a "recording device" comprises, as means for performing recording on cut sheet paper P or roll paper RP as a "recording medium," a conveying drive roller 11, a conveying driven roller 12, a recording paper support member 13, an ejecting drive roller 14, an ejecting driven roller 15, a carriage 16, and a recording head 17.

The conveying drive roller 11 is formed with a high-friction film covering laid over the external peripheral surface of a metal shaft, and is rotated by the transmission of rotational drive force of a motor (not shown). The conveying driven roller 12 is axially supported in a manner capable of being driven to rotate in a state of being urged toward contact with the conveying drive roller 11. The recording paper support member 13 is a member for supporting the cut sheet paper P or the roll paper RP in the recording performing region (a region where ink is ejected by the recording head 17). Between the recording paper support member 13 and the ejecting drive roller 14 is installed an auxiliary support member 131 for supporting the cut sheet paper P or roll paper RP passing over the recording paper support member 13 and guiding the cut sheet paper P or roll paper RP to the ejecting drive roller 14. The ejecting drive roller 14 is rotated by the transmission of rotational drive force of a motor (not shown). The ejecting driven roller 15 is axially supported in a manner capable of being driven to rotate, and is urged toward contact with the ejecting drive roller 14.

The carriage 16 is supported in a manner capable of moving back and forth in a primary scanning direction by a carriage guide shaft 18 and a carriage support frame 19. This primary scanning direction is a direction which intersects a secondary scanning direction Y (the conveying device of the cut sheet paper P or roll paper RP) along the recording surface (the surface on which recording is performed; likewise hereinbelow) of the cut sheet paper P or roll paper RP supported on the recording paper support member 13. The carriage guide shaft 18 and the carriage support frame 19 are set up along the primary scanning direction. An endless belt which rotates in two directions by the rotational drive force of a motor (not shown) is connected to the carriage 16. The endless belt is installed between a drive pulley and a driven pulley (not shown) of the motor, and is set up substantially parallel to the carriage guide shaft 18 and the carriage support frame 19. The carriage 16 can be moved back and forth in the primary scanning direction by rotating the endless belt in two directions by the drive force of the motor.

The recording head 17 is mounted on the carriage 16. The recording head 17 is mounted on the carriage 16 so that the head surface faces the recording surface of the cut sheet paper P or roll paper RP supported on the recording paper support member 13. The head surface of the recording head 17 is provided with numerous ejection nozzles (not shown) for ejecting ink and forming dots on the recording surface of the cut sheet paper P or roll paper RP. Ink is supplied to the recording head 17 via an ink tube (not shown) from an ink tank (not shown) provided to the main body of the inkjet printer 1.

Furthermore, the inkjet printer 1 comprises a conventional automatic feeding device (not shown) for conveying the cut sheet paper P to the conveying drive roller 11, and a roll paper feeding device 20 as a "conveying device" for conveying the roll paper RP to the conveying drive roller 11. The roll paper RP is conveyed in the route shown by the symbol A, and the cut sheet paper P is conveyed in the route shown by the symbol B. The roll paper feeding device 20 has a roll paper support shaft 21, a first guiding member 22, a feeding drive roller 23, a feeding driven roller 24, a second guiding member 25, a flap 26, two roll paper guiding rollers 27, and a third guiding member 28.

The roll paper support shaft 21 supports the recording surface around which the roll paper RP is wound, and is rotated by the transmission of rotational drive force of a motor (not shown). The first guiding member 22 is a member for guiding the roll paper RP to the feeding drive roller 23. The feeding drive roller 23 and the feeding driven roller 24 constitute a "roller pair" for sandwiching the roll paper RP. The feeding drive roller 23 is rotated by the transmission of rotational drive force of a motor (not shown). The feeding driven roller 24 is axially supported in a manner capable of being driven to rotate in a feeding driven roller holder 31. The second guiding member 25 is a member for guiding the roll paper RP to the flap 26. The flap 26 is swingably supported and is swung by a swinging mechanism (not shown). This flap 26 is a member for selectively switching between the conveying route A of the roll paper RP and the conveying route B of the cut sheet paper P. The two roll paper guiding rollers 27 are supported in a manner capable of being driven to rotate, and are driven to rotate in contact with the roll paper RP. The third guiding member 28 is a member for guiding the roll paper RP to the conveying drive roller 11. The roll paper RP supported on the roll paper support shaft 21 is fed to the conveying drive roller 11 by the rotation of the roll paper support shaft 21 and the feeding drive roller 23.

In the inkjet printer 1 configured as described above, recording is performed on the recording surface by alternately repeating between an operation in which the cut sheet paper P or roll paper RP being fed is supported on the recording paper support member 13 and ink is ejected from the head surface of the recording head 17 moving back and forth in the primary scanning direction to form dots on the recording surface, and an operation in which the cut sheet paper P or roll paper RP is conveyed a predetermined conveyed amount in the secondary scanning direction Y by the rotation of the conveying drive roller 11 and the ejecting drive roller 14. This series of recording control and the control of the automatic feed device and roll paper feeding device 20 previously described are performed by a control device 100 having a conventional microcomputer control circuit.

Configuration of Pressure Device 30

Figure 2:
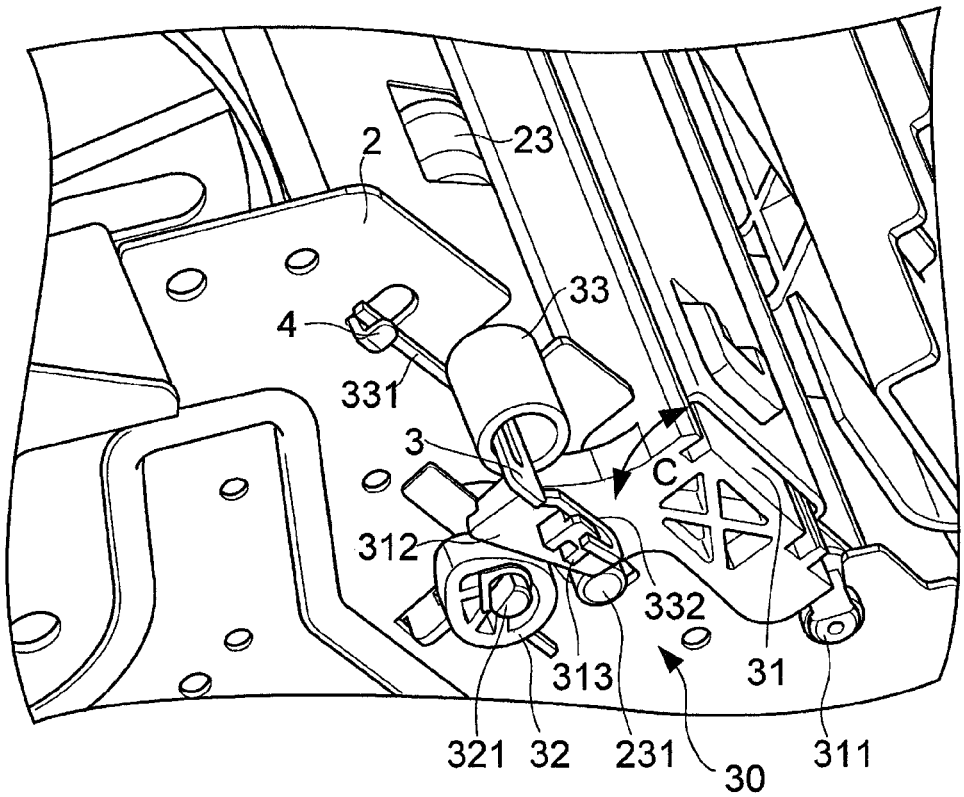
FIG. 2 is a perspective view showing an enlargement of the portion of a roll paper feeding device where a pressure device is installed.
Figure 3:
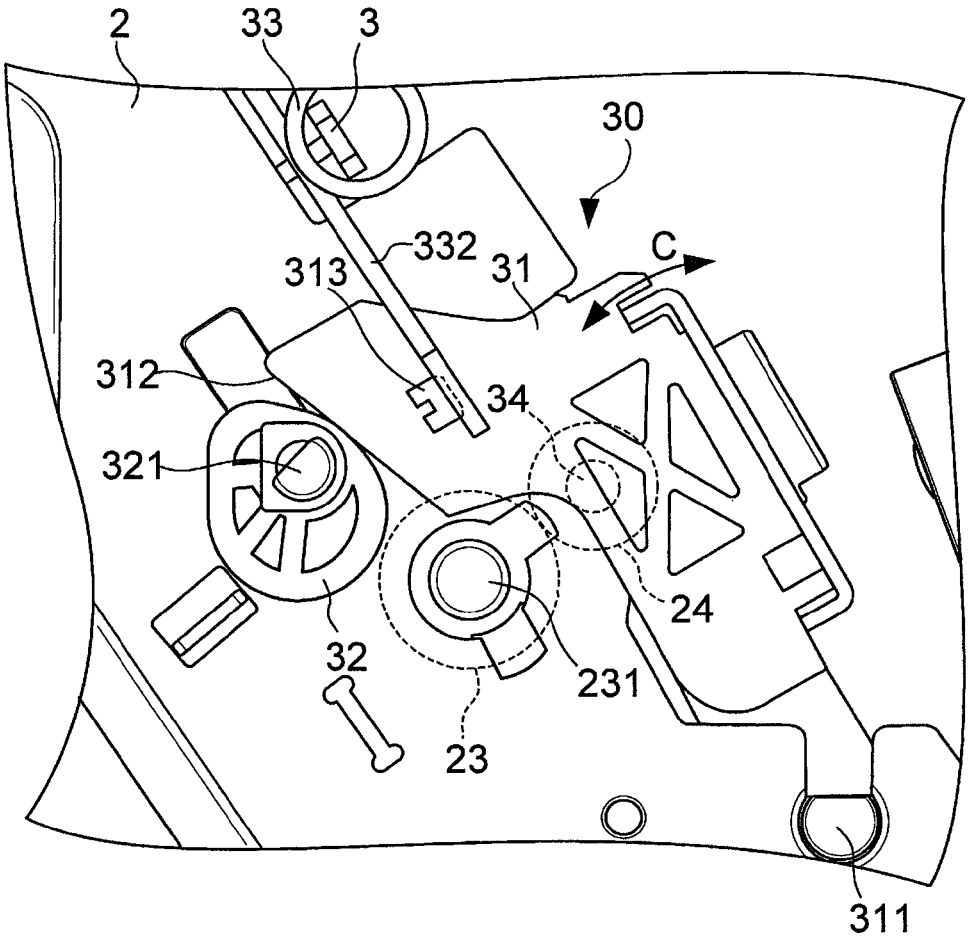
FIG. 3 is a side view showing an enlargement of the portion of a roll paper feeding device where a pressure device is installed.
Figure 4:
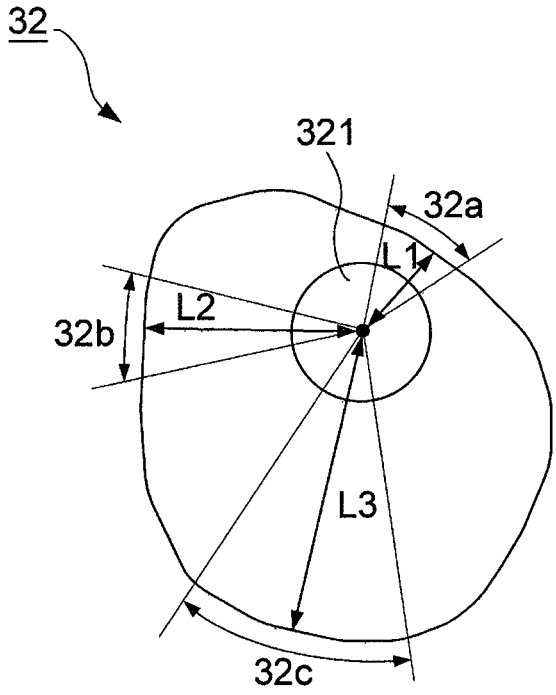
FIG. 4 is a side view of an eccentric cam of the pressure device.

The configuration of a pressure device 30 is described while referring to FIGS. 2 through 4.

FIG. 2 is a perspective view showing an enlargement of the part of the roll paper feeding device 20 where the pressure device 30 is installed, and FIG. 3 is a side view thereof. FIG. 4 is a side view of an eccentric cam 32 of the pressure device 30.

The pressure device 30 is a device for pressing the feeding driven roller 24 into the feeding drive roller 23, and the pressure device 30 has the previously described feeding driven roller holder 31, the eccentric cam 32, a torsion coil spring 33, and a rod spring 34.

The feeding drive roller 23 is capable of rotating around a shaft 231 as a rotational shaft and is supported on a left side frame 2 and a right side frame (not shown) constituting part of the casing of the inkjet printer 1. The feeding driven roller 24 is axially supported on the rod spring 34 provided to the feeding driven roller holder 31. The feeding driven roller holder 31 is supported on the left side frame 2 and the right side frame in a manner capable of swinging in a swinging direction indicated by the symbol C around a shaft 311 as a swinging axis.

The eccentric cam 32 constituting a "pressure load switching mechanism" and a "separating mechanism" is supported on the left side frame 2 in a manner capable of rotating about a shaft 321 as a rotational axis, and is rotated by the transmission of rotational drive force of a motor (not shown). The cam profile of the eccentric cam 32 has a region 32*a* in which the distance from the center point of the shaft 321 to the cam surface is L1, a region 32*b* in which the distance from the center point of the shaft 321 to the cam surface is a L2 which is longer than L1, and a region 32*c* in which the distance from the center point of the shaft 321 to the cam surface is L3 which is longer than L2 (FIG. 4). Control of the rotation of the eccentric cam 32 is performed by the control device 100 (FIG. 1).

The torsion coil spring 33 is supported on a protuberance 3 of the left side frame 2. One end 331 of the torsion coil spring 33 is interlocked with a spring catch 4 of the left side frame 2, and the other end 332 of the torsion coil spring 33 is engaged with a spring engager 313 of the feeding driven roller holder 31. Specifically, in the feeding driven roller holder 31, a cam contact part 312 is urged in a swinging direction toward contact with the eccentric cam 32 by the spring force of the torsion coil spring 33.

Action of the Pressure Device 30

Figure 5:
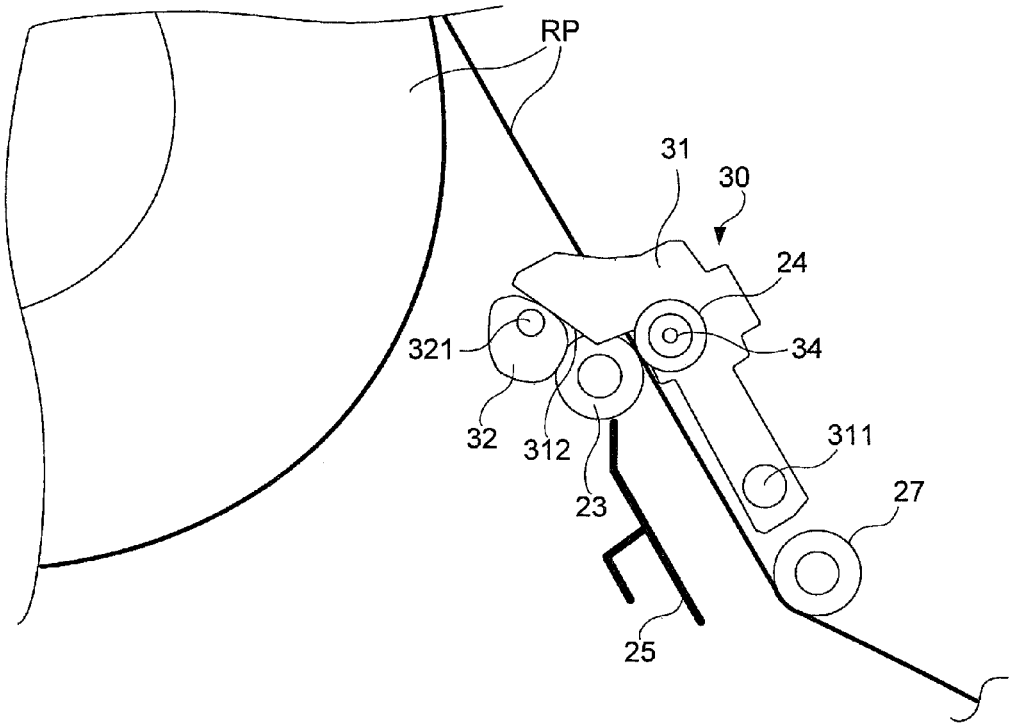
FIG. 5 is a side view schematically depicting part of the roll paper feeding device (with the first pressure load set)
Figure 6:
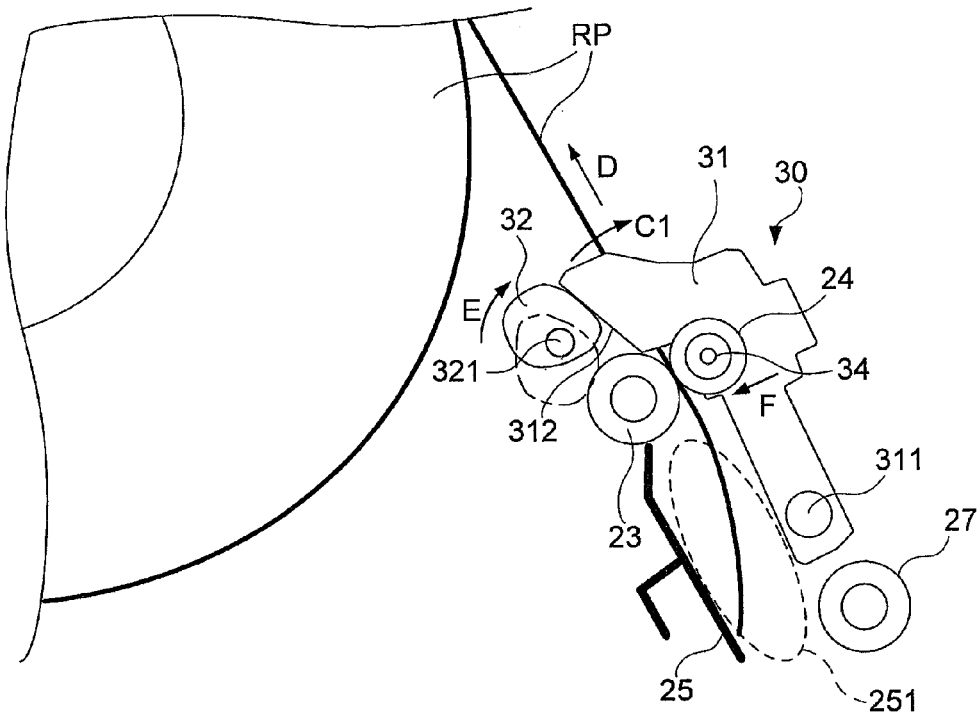
FIG. 6 is a side view schematically depicting part of the roll paper feeding device (with the second pressure load set)
Figure 7:
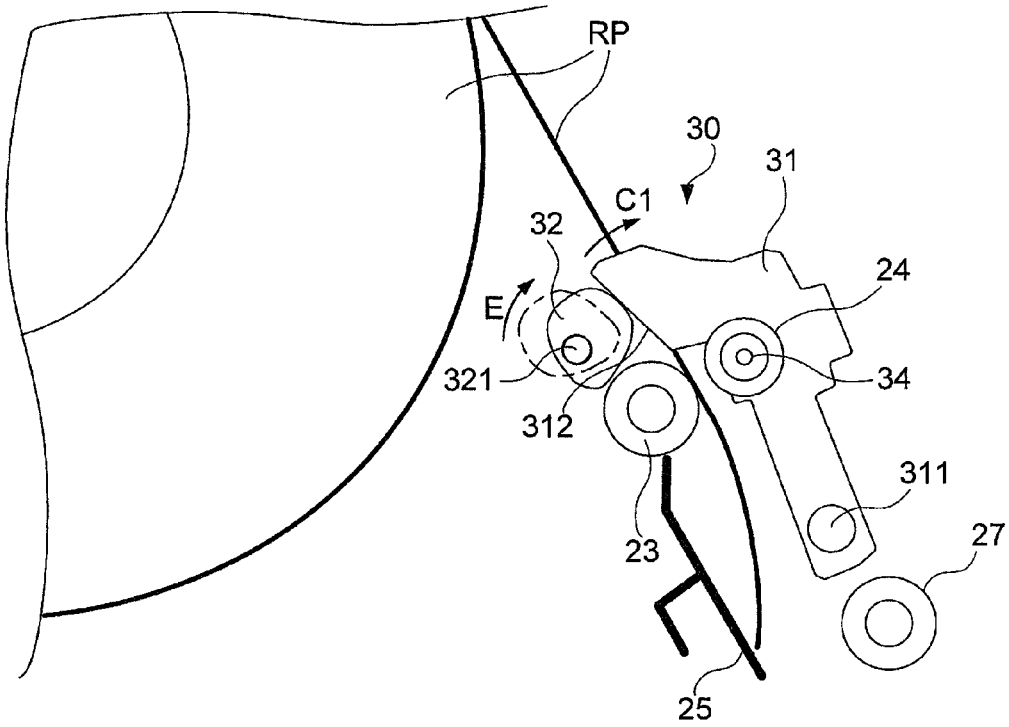
FIG. 7 is a side view schematically depicting part of the roll paper feeding device (with the roller pair separated).

The action of the pressure device 30 is described while referring to FIGS. 5 through 7. FIGS. 5 through 7 are side views schematically depicting part of the roll paper feeding device 20.

FIG. 5 shows a state in which the region 32*a* of the came surface of the eccentric cam 32 is in contact with the cam contact part 312 of the feeding driven roller holder 31.

In this state, the feeding driven roller 24 is pressed against the feeding drive roller 23 by the spring force of the rod spring 34. At this time, the pressure load of the feeding driven roller 24 against the feeding drive roller 23 sandwiches the roll paper RP between the feeding drive roller 23 and the feeding driven roller 24, and the pressure load is set to a load (first pressure load) sufficient to achieve stable conveying in which no slipping or the like occurs in the contact surfaces of the feeding drive roller 23 and the roll paper RP when the roll paper RP is conveyed by the rotation of the feeding drive roller 23. Specifically, the first pressure load is set to approximately 1.5 kgf in this example.

FIG. 6 shows a state in which the region 32*b* of the cam surface of the eccentric cam 32 is in contact with the cam contact part 312 of the feeding driven roller holder 31.

For example, in cases such as when the power source of the inkjet printer 1 is off or the inkjet printer 1 is operating in a power conservation mode in which power consumption is reduced, there are cases in which recording is not performed on the roll paper RP for a long period of time. In such cases, the control device 100 retracts the roll paper RP from the recording performing region on the condition that the operation for turning the power source of the inkjet printer 1 off has been performed, or the condition that the operating mode of the inkjet printer 1 has been switched to the power conservation mode.

More specifically, first, the roll paper RP is conveyed in the opposite direction D from the state shown in FIG. 5, the roll paper RP is retracted from the recording performing region, and the distal end of the roll paper RP is brought to the state between the feeding drive roller 23 and feeding driven roller 24 and the recording performing region (the state shown in FIG. 6). The roll paper RP is kept in standby in this state, which makes the procedure for setting the roll paper RP again unnecessary when recording is next performed on the roll paper RP, and it will be possible to immediately perform recording on the roll paper RP.

Next, the eccentric cam 32 is rotated from this state in the rotational direction indicated by the symbol E, and the region 32*b* of the cam surface of the eccentric cam 32 is brought into contact with the cam contact part 312 of the feeding driven roller holder 31. The feeding driven roller holder 31 is thereby swung a specified amount (an amount equivalent to the difference between L1 and L2) in a swinging direction C1 away from the feeding drive roller 23.

In this state, the feeding driven roller 24 is displaced in the direction shown by the symbol F by the spring force (the elastic return force) of the rod spring 34 axially supporting the feeding driven roller 24, and the feeding driven roller 24 is kept pressed against the feeding drive roller 23 by the spring force of the rod spring 34. In other words, the distal end vicinity of the roll paper RP is kept sandwiched between the feeding drive roller 23 and the feeding driven roller 24. The pressure load of the feeding driven roller 24 against the feeding drive roller 23 at this time is a pressure load (the second pressure load) that is lower than the first pressure load by an amount proportionate to the swinging of the feeding driven roller holder 31 in the swinging direction C1 away from the feeding drive roller 23. Specifically, in this example, the second pressure load is set to approximately 0.5 kgf, which is approximately ⅓ of the first pressure load. Thereby, in the standby mode in which recording is not performed on the roll paper RP for a long period of time, it is possible to reduce the risk of pressure marks forming from the feeding driven roller 24 on the recording surface of the roll paper RP.

The second pressure load is preferably set to as low of a load as possible within a range whereby the roll paper RP can be kept sandwiched between the feeding drive roller 23 and the feeding driven roller 24. The switching of the pressure load by the rotation of the eccentric cam 32 is preferably performed automatically by the motor control by the control device 100 as in this example, the object being to preemptively prevent errors in setting the pressure load and other problems, but a mechanism may also be provided which allows the user to switch the pressure load by manually rotating the eccentric cam 32, for example.

The roll paper feeding device 20 has a space 251 formed by the second guiding member 25 downstream of the feeding drive roller 23. This space 251 makes it possible for the distal end vicinity of the roll paper RP sandwiched between the feeding drive roller 23 and the feeding driven roller 24 to be kept in standby in an orientation in which the wound curl of the roll paper RP is maintained. This space 251 is not an essential structural element in the present invention, but by providing such a space 251, the wound curl of the roll paper RP is maintained while the roll paper RP is kept in standby sandwiched between the feeding drive roller 23 and the feeding driven roller 24. Specifically, it is possible to avoid force resulting from warping, deformation, or other problems in which the recording surface curves into a concave shape from acting on the roll paper RP being kept in standby sandwiched between the feeding drive roller 23 and the feeding driven roller 24. Thereby, when the roll paper RP is kept sandwiched between the feeding drive roller 23 and the feeding driven roller 24 for a long period of time, it is possible to avoid warping, deformation, or other problems in which the recording surface curves into a concave shape from occurring in the roll paper RP, for example. Therefore, when recording is thereafter performed on the roll paper RP, it is possible to reduce the risk of so-called head friction, paper jamming, and other problems occurring as a result of warping, deformation, or other problems in the roll paper RP.

FIG. 7 shows a state in which the region 32*c* of the cam surface of the eccentric cam 32 is in contact with the cam contact part 312 of the feeding driven roller holder 31.

From the state shown in FIG. 6, the eccentric cam 32 is further rotated in the rotational direction shown by the symbol E, and the region 32*c* of the cam surface of the eccentric cam 32 is brought into contact with the cam contact part 312 of the feeding driven roller holder 31. The feeding driven roller holder 31 is thereby swung by a specified amount (an amount equivalent to the difference between L2 and L3) in the swinging direction C1 away from the feeding drive roller 23. In this state, the feeding driven roller 24 separates from the feeding drive roller 23, and the user can easily perform the operation of setting the roll paper RP in the roll paper feeding device 20 as well as the operation of removing the roll paper RP from the roll paper feeding device 20.

According to the present invention, as described above, it is possible to reduce the risk of pressure marks from the feeding driven roller 24 being formed in the recording surface of the roll paper RP or the like, without compromising convenience, which is one merit of using roll paper RP or the like.

Other Examples, Modifications

The present invention is not limited to the examples described above, and needless to say, various modifications can be made within the range of the invention put forth in the claims, which modifications are also included within the range of the present invention.

For example, in an inkjet printer 1 in which the feeding drive roller 23 and the feeding driven roller 24 are not provided and their functions are taken up by the conveying drive roller 11 and the conveying driven roller 12, the present invention can be applied to the conveying drive roller 11 and the conveying driven roller 12, and the operative effects of the present invention can be achieved in such an embodiment as well.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording apparatus comprising:

a roller configured and arranged to convey a recording medium; and a control device configured and arranged to set a pressure load of the roller contacting with the recording medium, wherein the control device is configured and arranged to set the pressure load of the roller to a first pressure load when the recording medium is conveyed, and to set the pressure load of the roller to a second pressure load which is lower than the first pressure load when the recording medium is not conveyed while the roller is in contact with the recording medium.

2. The recording apparatus according to claim 1, wherein the roller includes a drive roller and a driven roller, and one of the drive roller and the driven roller is pressed into the other one of the drive roller and the driven roller.

3. The recording apparatus according to claim 2, further comprising:

a recoding device configured and arranged to perform recording on the recording medium which is conveyed by the roller, wherein a distal end of the recording medium is located downstream from the roller and upstream from a recoding region in which recording is performed on the recording medium by the recording device in a conveying route when recording is not performed.

4. The recording apparatus according to claim 1, further comprising:

a recoding device configured and arranged to perform recording on the recording medium which is conveyed by the roller, wherein a distal end of the recording medium is located downstream from the roller and upstream from a recoding region in which recording is performed on the recording medium by the recording device in a conveying route when recording is not performed.

5. The recording apparatus according to claim 4, wherein the control device is configured and arranged to set the pressure load of the roller to the second pressure load on a condition that a power source of the recording device has been turned off or on a condition that an operation mode of the recording device has been switched to a power conservation mode.

6. The recording apparatus according to claim 1, further comprising:

a recoding device configured and arranged to perform recording on the recording medium which is conveyed by the roller; and a supporting device configured and arranged support the recording medium being conveyed by the roller to a recoding region in which recording is performed on the recording medium by the recording device, wherein a distal end of the recording medium is located in a position separated from the supporting device when recording is not performed.

7. The recording apparatus according to claim 6, wherein the distal end of the recording medium is located on an upper side than the supporting device in a vertical direction when recording is not performed.

8. The recording apparatus according to claim 1, wherein the first pressure load is a pressure load that allows the roller to convey the recoding medium, and the second pressure load is a pressure load that allows the roller to hold the recoding medium.

9. A recording method for a recording apparatus including a roller for conveying a recording medium and a recoding device for performing recording on the medium, the recording method comprising:

setting a pressure load of the roller contacting with the recording medium to a first pressure load when the recording medium is conveyed; and setting the pressure load of the roller contacting with the recording medium to a second pressure load which is lower than the first pressure load when the recording medium is not conveyed.

10. The recording method according to claim 9, further comprising:

locating a distal end of the recording medium downstream from the roller and upstream from a recoding region in which recording is performed on the recording medium by the recording device in a conveying route when recording is not performed.

11. The recording method according to claim 9, wherein the recording apparatus includes a supporting device supporting the recording medium being conveyed by the roller to a recoding region in which recording is performed on the recording medium by the recording device, further comprising:

locating a distal end of the recording medium in a position separated from the supporting device when recording is not performed.

12. The recording method according to claim 11, further comprising locating the distal end of the recording medium on an upper side than the supporting device in a vertical direction when recording is not performed.

13. The recording method according to claim 9, wherein the first pressure load is a pressure load that allows the roller to convey the recoding medium, and the second pressure load is a pressure load that allows the roller to hold the recoding medium.

* * * * *